US007575498B2

(12) United States Patent
Perry

(10) Patent No.: US 7,575,498 B2
(45) **Date of Patent: *Aug. 18, 2009**

(54) MAGNETIC TOP TOYS

(76) Inventor: Michael C. Perry, 136 S. Euclid, Oak Park, IL (US) 60302

( * ) Notice: Subject to any disclaimer, the term of this patent is extended or adjusted under 35 U.S.C. 154(b) by 333 days.

This patent is subject to a terminal disclaimer.

(21) Appl. No.: 11/534,423

(22) Filed: Sep. 22, 2006

(65) Prior Publication Data

US 2007/0049161 A1 Mar. 1, 2007

Related U.S. Application Data

(63) Continuation-in-part of application No. 11/086,499, filed on Mar. 22, 2005, now Pat. No. 7,275,974.

(60) Provisional application No. 60/719,639, filed on Sep. 22, 2005.

(51) Int. Cl.
*A63H 33/26* (2006.01)
*A63H 33/00* (2006.01)

(52) U.S. Cl. ..... 446/138; 446/263; 446/129; 273/109

(58) Field of Classification Search ..... 446/109, 446/129, 138, 263, 438, 441, 444, 447, 450
See application file for complete search history.

(56) References Cited

U.S. PATENT DOCUMENTS

| | | | | |
|---|---|---|---|---|
| 870,146 | A | 11/1907 | Webb | |
| 884,391 | A | 4/1908 | Johansson | |
| 1,005,853 | A | 10/1911 | Lewis | |
| 1,322,217 | A | 11/1919 | Anderson | |
| 1,403,200 | A | 1/1922 | Sandstrom | |
| 2,034,293 | A | 3/1936 | Hacker | |
| 2,818,680 | A | 1/1958 | Borsos | |
| 3,074,206 | A * | 1/1963 | Fischl-bernfi et al. | 446/138 |
| 3,785,652 | A | 1/1974 | Ghovanloo | |
| 4,031,660 | A | 6/1977 | Chen | |
| 4,290,225 | A | 9/1981 | MacCarthy | |
| D275,582 | S | 9/1984 | MacCarthy | |
| 4,501,568 | A * | 2/1985 | Nagaoka | 446/450 |
| 4,531,923 | A | 7/1985 | Lohr | |
| D290,857 | S | 7/1987 | Lohr | |
| D436,383 | S | 1/2001 | Chesler | |
| D506,230 | S | 6/2005 | Perry | |

* cited by examiner

*Primary Examiner*—Kien T Nguyen
(74) *Attorney, Agent, or Firm*—Vedder Price P.C.

(57) ABSTRACT

A top toy including a track component for supporting a wheel-type top. Each track member has a peripheral rim to cooperatively form a two-rail track. Each of the rims is configured non-circular such that the magnetic spindles of the wheel-type top move toward and away from an axis of a shaft of the track component as the top travels on the rims about the axis of the shaft.

16 Claims, 5 Drawing Sheets

MAGNETIC TOP TOYS

RELATED APPLICATION

This application claims benefit of and priority from U.S. Provisional Application Ser. No. 60/719,639, filed Sep. 22, 2005; and is a continuation in part of U.S. application Ser. No. 11/086,499, filed Mar. 22, 2005, which claim the benefit of and priority from U.S. application Ser. No. 29/206,018, now U.S. Pat. No. D506,230, each of which is incorporated herein in their entirety by this reference.

BACKGROUND

This application relates generally to toys of the type that include the combination of (1) a top having a wheel-shaped body with magnetic spindles projecting in opposite directions from the axis of rotation of the body, and (2) an apparatus that can be manipulated to cause the top to spin, or to travel in a particular path dictated by the configuration of a pair of spaced rails enclosing a shaft. The spinning top can be separated from the apparatus to spin on a floor, or other surface.

Conventional top toys include combinations of tops having wheel-shaped bodies with wire rails, a spiral track, and the like. The tops have wheel-shaped bodies with magnetic spindles projecting from opposite sides of the body for securing the top to rails by magnetic attraction.

BRIEF DESCRIPTION OF THE DRAWINGS

The features of the present disclosure are believed to be novel and are set forth with particularly in the appended claims. The disclosure may be best understood by reference to the following description taken in conjunction with the accompanying drawings. The figures that employ like reference numerals identify like elements.

DETAILED DESCRIPTION OF THE PREFERRED EMBODIMENTS

In the following detailed description, reference is made to the accompanying drawings that show, by way of illustration, a possible industrial embodiment of the disclosure centered around magnetic top toy. This embodiment is described with detail sufficient to enable one skilled in the art to practice the disclosure. It is understood that each subfeature or element described in this embodiment of the disclosure, although unique, is not necessarily exclusive and can be combined differently and in a plurality of other possible embodiments because they show novel features. It is understood that the location and arrangement of individual elements, such as geometrical parameters within each disclosed embodiment, may be modified without departing from the spirit and scope of the disclosure. In addition, this disclosed embodiment can be modified based on a plurality of industrial and commercial necessities. The disclosed apparatus can be modified according to known design parameters to implement this disclosure within these specific types of operation. Other variations will also be recognized by one of ordinary skill in the art. The following detailed description is, therefore, not to be taken in a limiting sense.

In accordance with one principal aspect of the present disclosure, a top toy includes a track component that includes a peripheral rim associated with each track member to cooperatively form a two-rail track. Each of the rims is non-circular such that the magnetic spindles of the wheel-type top move toward and away from an axis of a shaft of the track component as the top travels on the rims.

Figure 1:
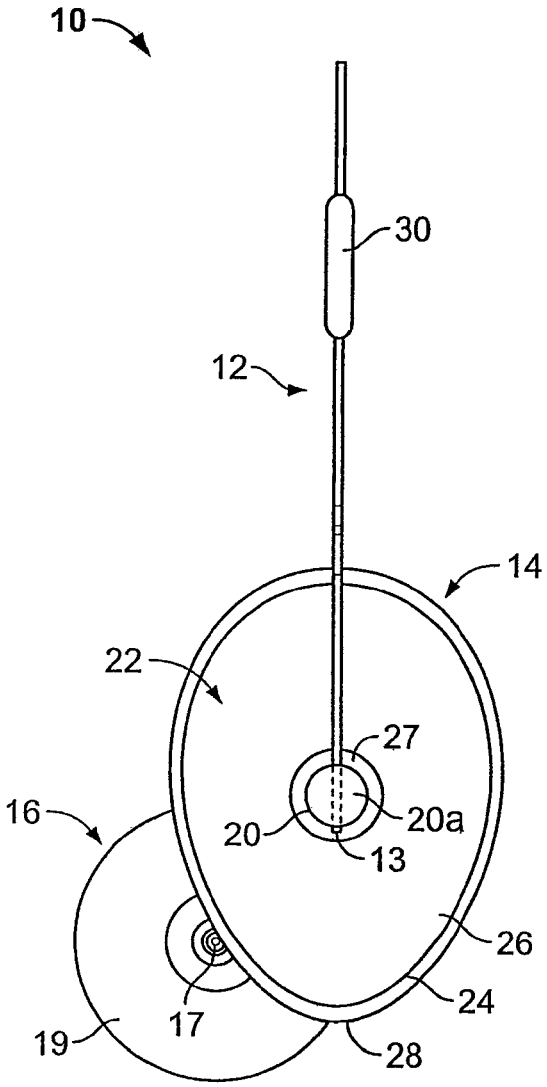
FIG. 1 is a side elevation view of one embodiment of a magnetic top toy according to this disclosure.
Figure 2:
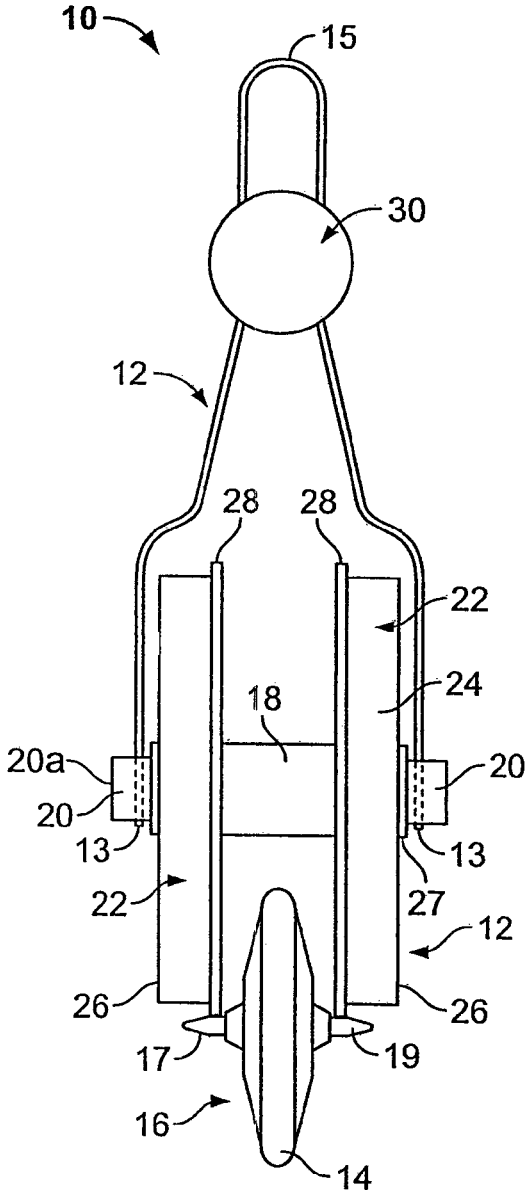
FIG. 2 is a front view of the toy of FIG. 1.

Reference is made to FIGS. 1 and 2, wherein reference numeral 10 collectively designates the assembled toy, which comprises three primary components, namely: a top 16; a track component 14; and a handle 12. The top 16 has a generally wheel-shaped body 19 with an axle having a spindle 17 at each end that projects from a respective side of the wheel-shaped body 19 along its axis of rotation. The track component 14 includes a shaft 18 with reduced-size ends, each of which is connected to a cylindrical end cap 20 having a closed end 20*a*.

A track member 22 is mounted on each of the reduced ends 20, and is fixed against rotation with respect to the shaft 18; hence, shaft 18, and its reduced ends can perform their respective functions whether of circular or non-circular cross section.

Each track member 22 preferably has a non-circular configuration and, in this embodiment, has a flat, generally oval-shaped end wall 26 that is formed with a flared opening 27 that receives one of the reduced ends of shaft 18. The flared material that surrounds the opening is clamped between the open end of cap 20 and a circular portion of the large end of shaft 18 that surrounds the reduced end. It is within the teachings of this disclosure that the track members 22 may be configured in any suitable form, such as, non-circular, oval, square, triangle, cloverleaf, ellipse, tetragon, trapezium, trapezoid, parallelogram, gnomon, rhombus, deltoid, pentagon, pentagram, polygon, lemniscate, obround, or any other suitable configuration or form.

A side wall 24 projects substantially orthogonal from the periphery of the end wall 26 of each track member 22. The free edge of each side wall 24 is formed with an outwardly projecting raised rim 28, as shown in FIGS. 1 and 2. The track members 26 are mounted on the opposite ends of shaft 18 in opposed, mirror-image relation such that the opposed rims 28 define a two-rail track about shaft 18.

The handle 12 (as shown in FIGS. 1 and 2) is preferably formed of a wire member bent to form a curved, U-shaped bight 15 that defines one end of the handle 12. A pair of legs 18 project from the bight 15 and terminate at spaced free ends 13. A hole extends diametrically through the cylindrical wall of each end cap 20, as well as the reduced-diameter end portion of shaft 18. The free ends 13 of the handle 12 straddle the discs 26 and are received in a respective one of the holes as illustrated in FIGS. 1-8 by the dashed lines.

A circular clamp 30 is mounted on both legs of the handle 12 (as shown in FIGS. 1-8) at a location near the bight 15. The clamp 30 is formed by a pair of disks that are configured to allow one to fit into the other with a force-fit, snap-it or any other suitable or conventional connection feature, as may also be described in more detail in U.S. application Ser. No.

11/086,499 incorporated herein by reference. The clamp 30 is used as a gripping member for hand-manipulation of the operation of the toy.

Figure 3:
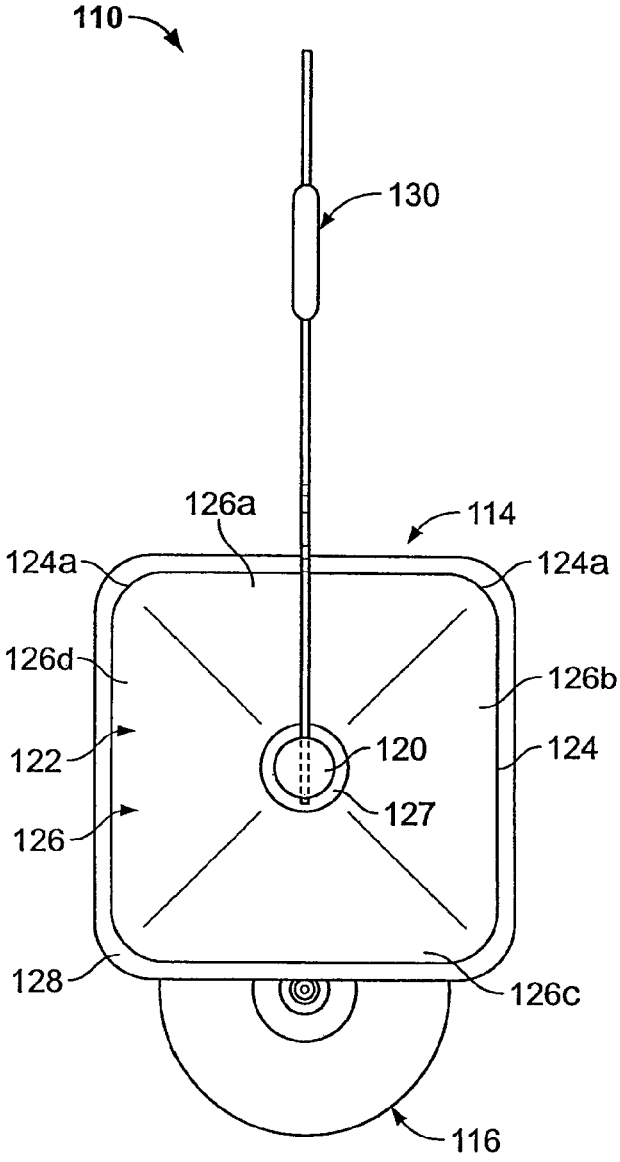
FIG. 3 is a side elevation view of another embodiment of a magnetic top toy according to this disclosure.
Figure 4:
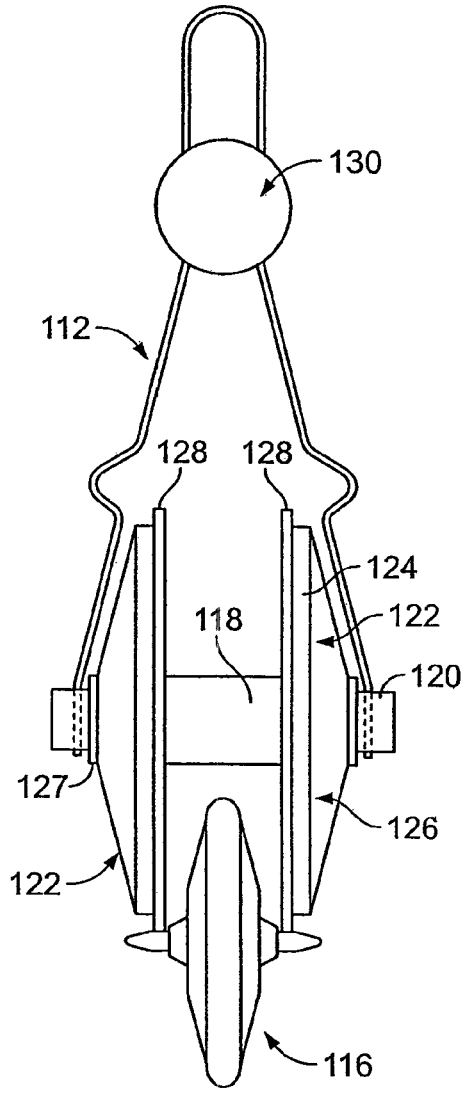
FIG. 4 is a front view of the toy of FIG. 3.

One preferred configuration of the top 16 is shown in detail in FIGS. 3 and 4 of U.S. application Ser. No. 11/086,499 incorporated herein by reference. Generally, as also shown in FIGS. 1-90 herein, the top 16 has a wheel-shaped body 19. A pair of magnetic spindles 17 project from opposite ends of the axle formed by the axle halves (illustrated in the exploded view of FIG. 4 of U.S. application Ser. No. 11/086,499). The spindles 17 are magnetized by a permanent magnet located between the flat ends of spindles 17. When the parts are assembled together, the flat ends of spindles 17 are each seated against respective flat ends of the magnet. The spindles are magnetized by the contact of the flat ends of the spindles with the respective flat ends of magnet. When assembled, the pointed ends of spindles 17 project from respective axle-halves.

In use, the magnetic spindles 17 of top 16 are movably connected by magnetic attraction to the rims 28 and move toward and away from the shaft 18 as the top 16 travels on the rims 28 about the shaft 18. A user may manipulate the clamp 30 to adjust the manner in which the top 16 travels on the rims 28 about the shaft 18, such as to adjust the connectivity thereof or to facilitate disconnection of the top 16 from the rims 28 so as to permit the top 16 to engage a surface.

Now referring to FIGS. 3 and 4, reference numeral 110 collectively designates another embodiment of the magnetic top toy in accordance with this disclosure that comprises three components: a top 116; a track component 114; and a handle 112.

The track component 114 comprises a pair of track members 122 mounted on a shaft 118 in spaced, opposed, mirror-image relationship in the same manner as the corresponding elements of the embodiment of FIGS. 1 and 2, namely elements identified by reference numerals 22.

Preferably, each track member 122 has a unitary, generally pyramid-shaped end wall 126 that formed with four integral triangular panels 126*a*, 126*b*, 126*c* and 126*d*. A flared opening 127 is formed at the apex of the end wall 126 to receive the reduced end of shaft 118.

A generally square side wall 124 (with rounded corners 124*a*) projects from the outer edge of the wall 126. The outer edge of the side wall 124 is formed with an outwardly projecting rim 128.

As shown in FIG. 4, the pair of opposed track members 122, as well as the rims 128 are disposed in opposed, mirror-image relationship with respect to each other such that the pair of rims 128 form a two-rail track about the shaft 118. The top 116 travels along rims 128 around the axis of shaft 118 along a path that is generally square with rounded corners. The handle 110, gripping member 130, wire legs 112, shaft 118, caps 120 and other elements are substantially structural and functional equivalents of the corresponding elements illustrated in the embodiment of FIGS. 1 and 2. Accordingly, details thereof will not be updated; however, will be incorporated herein by reference.

Figure 5:
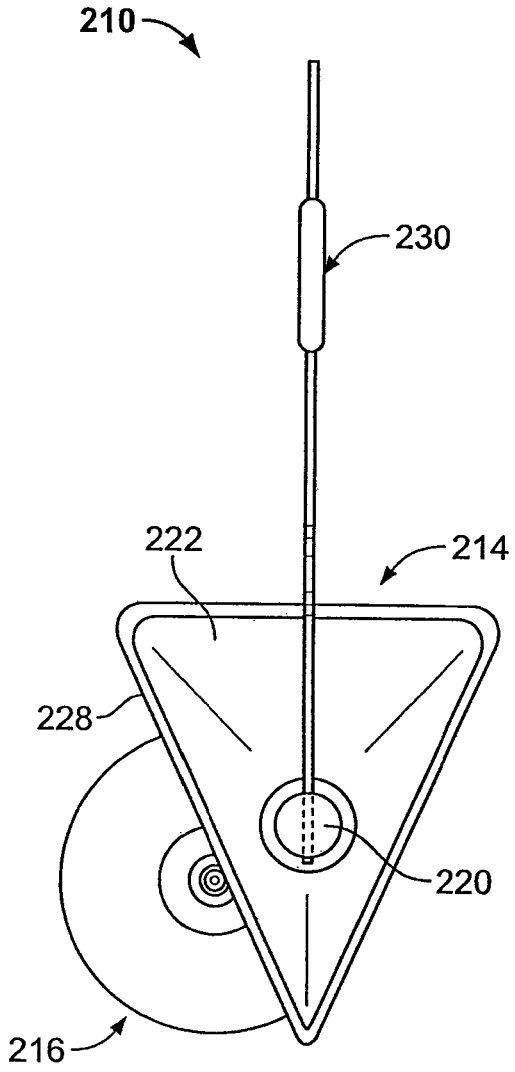
FIG. 5 is a side elevation view of another embodiment of a magnetic top toy according to this disclosure.
Figure 6:
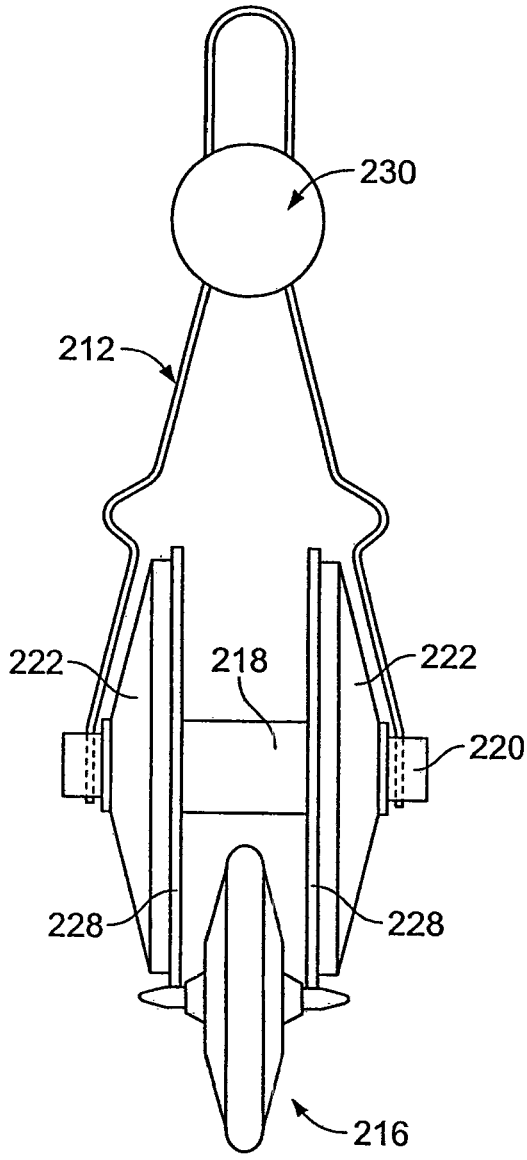
FIG. 6 is a front view of the toy of FIG. 5.

Referring now to the embodiment illustrated in FIGS. 5 and 6, which is substantially identical in all material structural and functional respects to FIGS. 3 and 4, except that the track members 222 are generally triangular instead of generally square. The top 216 travels along a two-rail, triangular track (with rounded corners) formed by rims 228.

Figure 7:
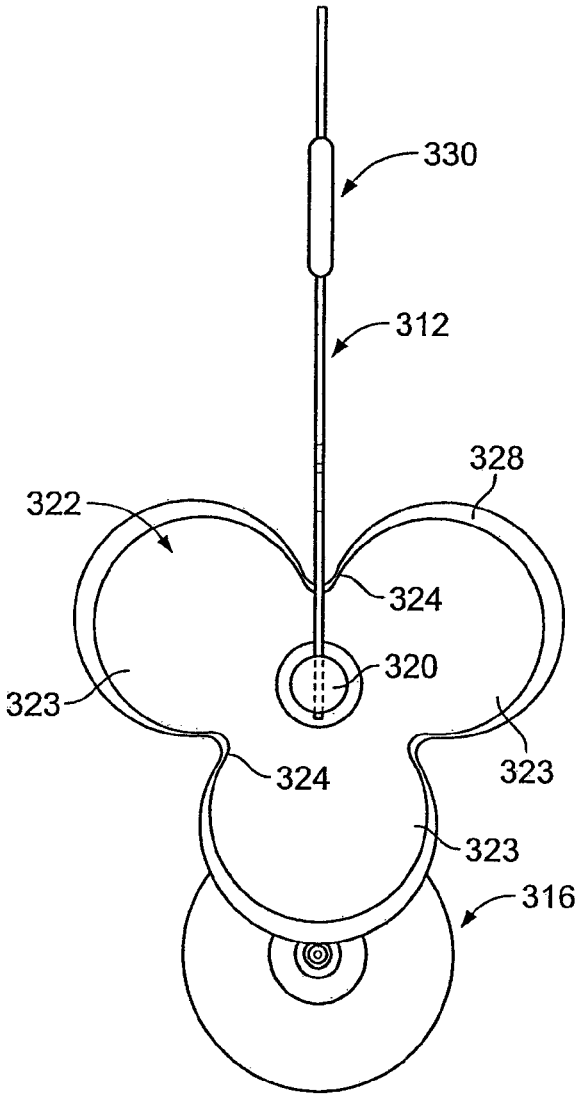
FIG. 7 is a side elevation view of another embodiment of a magnetic top toy according to this disclosure.
Figure 8:
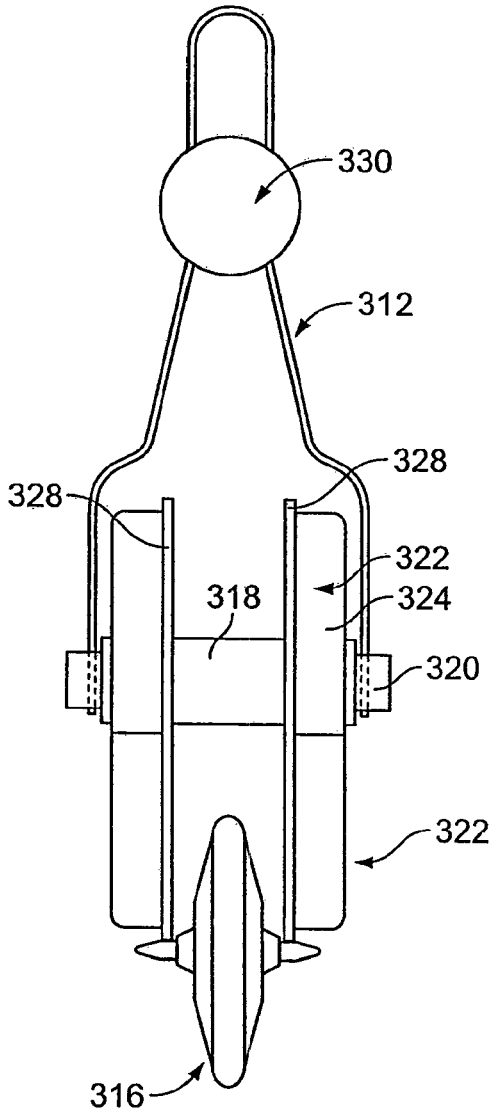
FIG. 8 is a front view of FIG. 7.

The embodiment illustrated in FIGS. 7 and 8 is substantially identical in all material structural and functional respects to the embodiment shown in FIGS. 3 and 4, except for the generally clover-leaf configuration of the track members illustrated in FIGS. 7 and 8.

Each track member 322 is generally configured in the form of a three-leaf clover, each leaf 323 is connected to the other two by a reverse-curve 324. A rim 328 projects outwardly from each leaf. The track members 322 are mounted on shaft 318 in opposed, mirror-image relationship to form a generally three-leaf track for the top 316.

Figure 10:
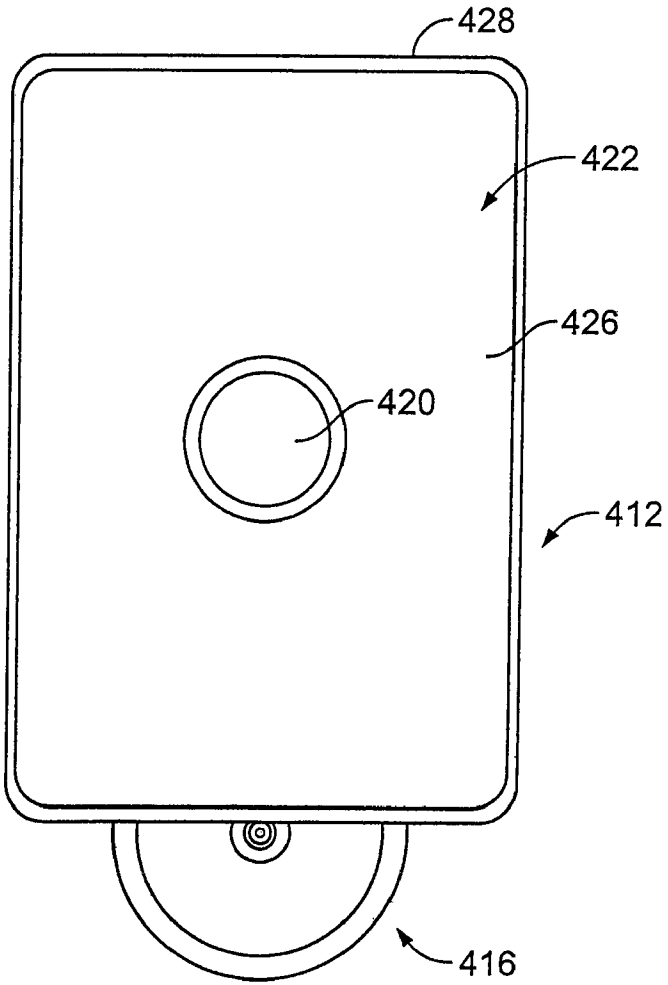
FIG. 10 is a side elevation of FIG. 9.
Figure 9:
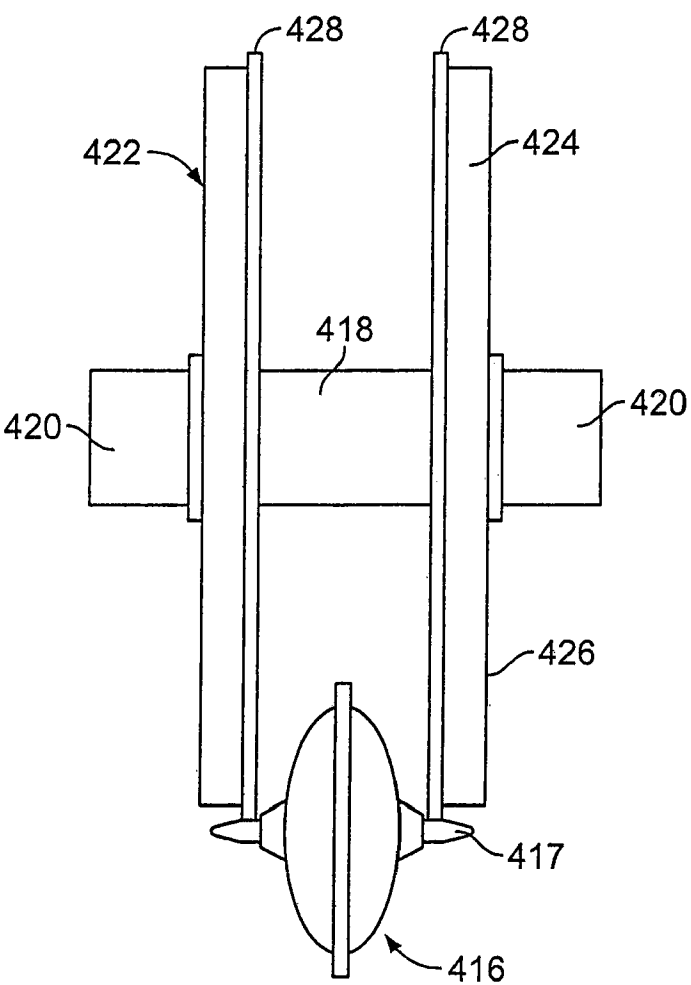
FIG. 9 is a front view of an embodiment of a rectangular track component according to this disclosure.

Referring now to the embodiment illustrated in FIGS. 9 and 10, reference numeral 412 collectively designates one embodiment of a track component which has a pair of rectangular track members 422. The track members 422 are mounted on a shaft 418 such that they are in spaced, opposed, mirror-image relationship. Cylindrical end caps 420 on the reduced ends of the shaft 418 secure the track members 422 against movement relative to shaft 418.

Each track member 422 has a flat end wall 426 configured with a generally rectangular shape with curved corners (as shown in FIG. 10), and a side wall 424 formed with a rim 428 that projects outwardly from the end of the side wall 424 that is remote from the end wall 426.

The invention as disclosed herein is not limited to the particular details of the described magnetic top toy and other modifications and application is may be contemplated. Further changes may be made in the above-described method and device without departing from the true spirit and scope of the invention herein involved. It is intended, therefore, that the subject matter in the above disclosure should be interpreted as illustrative, not in a limiting sense.

What is claimed is:

1. A top toy comprising:

a wheel-type top comprising magnetic spindles projecting in opposite directions from a body of the top; and a track component comprising:

a shaft;

a pair of track members disposed adjacent opposite ends of said shaft such that the track members are disposed in fixed, mirror-image relation to each other;

each track member having a peripheral rim defined thereon and in spaced, complementary relationship with the rim of the other track member to form a two-rail track about said shaft; and each of said rims comprising a non-circular configuration, wherein the magnetic spindles of the wheel-type top are movably connected by magnetic attraction to the rims and move toward and away from the shaft as the top travels on the rims about the shaft.

2. The toy of claim 1, further comprising a handle having a pair of legs straddling said track members, wherein free ends of said legs are connected to opposite ends of said shaft.

3. The toy of claim 2, wherein the handle has a bight portion disposed remote from the shaft to connect the pair of legs.

4. The toy of claim 3, further including a hand grip that connects said pair of legs at a location between said bight portion and the rims of said track members.

5. The toy of claim 1, wherein each rim has a general oval configuration.

6. The toy of claim 1, wherein each rim has a general square configuration.

7. The toy of claim 1, wherein each rim has a general triangular configuration.

8. The toy of claim 1, wherein each rim has a general clover leaf configuration.

9. A top toy comprising:

a track component adapted for magnetically engaging a wheel-type top, said track component comprising:

a shaft;

a pair of track members disposed adjacent opposite ends of said shaft such that the track members are disposed in fixed, mirror-image relation to each other;

each track member having a peripheral rim defined thereon and in spaced, complementary relationship with the rim of the other track member to form a two-rail track about said shaft; and each of said rims comprising a non-circular configuration, wherein the wheel-type top is adapted to be movably connected by magnetic attraction to the rims and move toward and away from the shaft as the top travels on the rims about the shaft.

10. The toy of claim 9, further comprising a handle having a pair of legs straddling said track members, wherein free ends of said legs are connected to opposite ends of said shaft.

11. The toy of claim 10, wherein the handle has a bight portion disposed remote from the shaft to connect the pair of legs.

12. The toy of claim 11, further including a hand grip that connects said pair of legs at a location between said bight portion and the rims of said track members.

13. The toy of claim 9, wherein each rim has a general oval configuration.

14. The toy of claim 9, wherein each rim has a general square configuration.

15. The toy of claim 9, wherein each rim has a general triangular configuration.

16. The toy of claim 9, wherein each rim has a general clover leaf configuration.

* * * * *